US008789380B2

(12) United States Patent
Lesage et al.

(10) Patent No.: US 8,789,380 B2
(45) Date of Patent: Jul. 29, 2014

(54) DEFROST SYSTEM AND METHOD FOR A SUBCRITICAL CASCADE R-744 REFRIGERATION SYSTEM

(75) Inventors: Gaétan Lesage, Blainville (CA); Jordan Kantchev, Longueuil (CA)

(73) Assignee: Systemes LMP Inc., Laval (Quebec) (CA)

( * ) Notice: Subject to any disclaimer, the term of this patent is extended or adjusted under 35 U.S.C. 154(b) by 1079 days.

(21) Appl. No.: 12/659,755

(22) Filed: Mar. 19, 2010

(65) Prior Publication Data

US 2011/0011104 A1 Jan. 20, 2011

Related U.S. Application Data

(60) Provisional application No. 61/213,836, filed on Jul. 20, 2009.

(51) Int. Cl.
*F25D 21/06* (2006.01)
*F25B 7/00* (2006.01)

(52) U.S. Cl.
CPC ..... *F25B 7/00* (2013.01)
USPC ..... 62/81

(58) Field of Classification Search
CPC ..... F25B 7/00; F25B 47/02; F25D 21/06
USPC ..... 62/80, 81, 324.1, 335, 238.7
See application file for complete search history.

(56) References Cited

U.S. PATENT DOCUMENTS

| | | | | |
|---|---|---|---|---|
| 3,150,498 | A * | 9/1964 | Blake | 62/81 |
| 3,468,135 | A | 9/1969 | Doll et al. | |
| 3,872,682 | A | 3/1975 | Shook | |
| 4,286,437 | A * | 9/1981 | Abraham et al. | 62/151 |
| 5,369,961 | A * | 12/1994 | Seiler | 62/271 |
| 5,507,154 | A * | 4/1996 | Grant | 62/156 |
| 6,216,481 | B1 * | 4/2001 | Kantchev | 62/238.7 |
| 6,449,967 | B1 * | 9/2002 | Dube | 62/156 |
| 6,807,813 | B1 * | 10/2004 | Lesage | 62/81 |
| 6,840,058 | B2 | 1/2005 | Suzuki et al. | |
| 2004/0003601 | A1 * | 1/2004 | Dube | 62/81 |
| 2006/0225458 | A1 * | 10/2006 | Lesage et al. | 62/510 |

FOREIGN PATENT DOCUMENTS

| | | | | |
|---|---|---|---|---|
| CA | 2559001 | A1 * | 3/2007 | F25B 37/00 |
| EP | WO2007054095 | A1 * | 5/2007 | F25B 47/02 |
| WO | WO2008112572 | A1 * | 9/2008 | F25B 7/00 |

* cited by examiner

*Primary Examiner* — Frantz Jules
*Assistant Examiner* — Emmanuel Duke
(74) *Attorney, Agent, or Firm* — Equinox IP; Franz Bonsang

(57) ABSTRACT

A cascade refrigeration system using a first refrigerant or a high stage and a second, R-744, refrigerant for low stage refrigeration has a defrost system including a defrost compressor, a defrost inlet heat exchanger and defrost outlet heat exchanger. The defrost inlet heat exchanger receives a defrost portion of second refrigerant and adds an additional defrost heat load thereto from first refrigerant, thus evaporating defrost portion. Defrost portion is then compressed into high pressure defrost vapor portion in the defrost compressor. The defrost vapor portion is then circulated through a selected evaporator, where a defrost heat, augmented by additional defrost heat load, defrosts selected evaporator, defrost vapor being at least partially condensed into defrost condensed portion which is liquefied in defrost outlet heat exchanger.

17 Claims, 1 Drawing Sheet

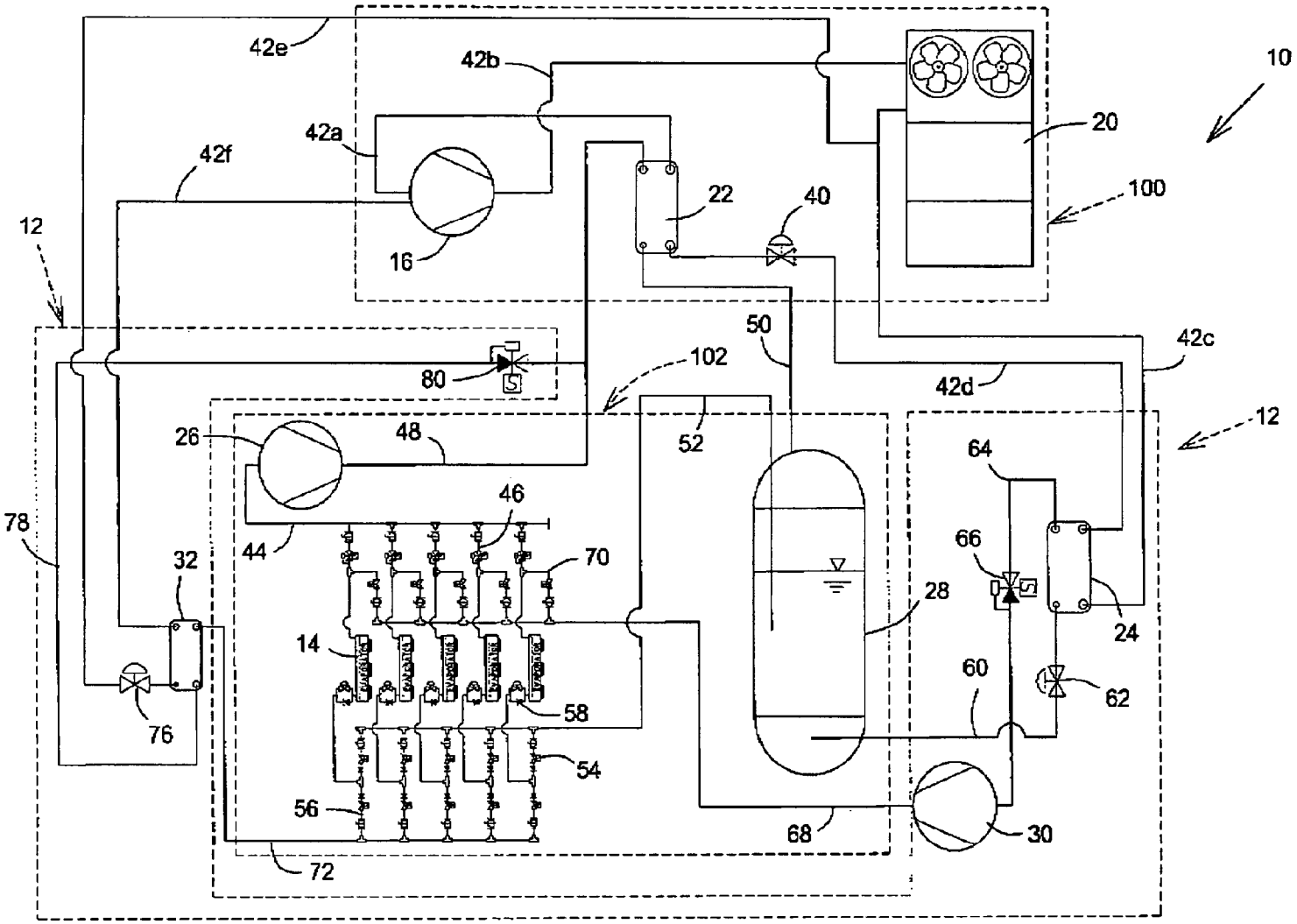
10
12
100
20
42c
24
62
30
64
66
60
42d
28
40
50
68
22
102
52
70
58
54
46
42b
80
48
16
42a
14
56
72
42e
44
26
42f
32
76
12
78

DEFROST SYSTEM AND METHOD FOR A SUBCRITICAL CASCADE R-744 REFRIGERATION SYSTEM

CROSS-REFERENCE TO RELATED APPLICATION

The present invention has been previously described in U.S. provisional patent application No. 61/213,836 filed on Jul. 20, 2009, of which priority benefit is claimed and which is incorporated herein by reference.

FIELD OF THE INVENTION

The present invention relates to defrost systems for refrigeration, and is more particularly directed to defrost system for a subcritical cascade R-744 refrigeration system.

BACKGROUND OF THE INVENTION

Cascade refrigeration systems are well known in the art. In such systems, a first refrigerant of a high stage system is compressed in a high stage compressor, condensed in a high stage condenser, and used, in a high stage evaporator, to condense a second refrigerant compressed by a low stage compressor and then evaporated in a low stage evaporator by absorption of heat from a thermal load, thereby cooling the load. Thus, the high stage system, and notably the high stage heat exchanger, is used as a condenser for the low stage system to condense the second refrigerant by absorption of heat therefrom.

A number of different refrigerants may be deployed in typical cascade refrigeration systems. However, due to environmental concerns, use of many conventional refrigerants containing or releasing CFC (chlorofluorocarbon) base chemicals is becoming less desirable. Instead, use of natural refrigerants or refrigerants having little ozone or global warming impart is increasingly in demand. R-744, or carbon dioxide, is such a refrigerant and is appropriate for use as a second, low stage refrigerant, in a cascade system.

Unfortunately, as with all refrigeration systems, the temperature of the evaporators must be maintained near or slightly below freezing to cool the load to desired temperature, which causes an accumulation of frozen water on the evaporators, and notably the low stage evaporators in cascade systems. Thus, the evaporators must be periodically defrosted. For current cascade systems using R-744 as the low stage refrigerant for the thermal load, the defrosting of the evaporators is effected using air defrost techniques for medium temperature applications, such as display case cooling of non-frozen foodstuffs, and electrical defrost techniques for low temperature applications, such as freezers. Unfortunately, air defrost systems and methods techniques, in which ambient or slightly heated air is blown by fans over the evaporators to melt the ice, are slow and require a great deal of space. Electrical defrost systems and methods, in which heating coils or heaters are deployed in proximity to or on the evaporators, require less time to defrost but use large amounts of electricity.

Accordingly, there is a need for an improved defrost system for a subcritical cascade R-744 refrigeration system.

SUMMARY OF THE INVENTION

It is therefore a general object of the present invention to provide an improved defrost system and method for a subcritical cascade R-744 refrigeration system.

An advantage of the present invention is that the defrost system and method provided thereby furnishes defrosting of the evaporators of refrigeration system while using less space than an air defrost system.

Another advantage of the present invention is that the defrost system and method uses less energy than an electrical defrost.

A further advantage of the present invention is that the defrost system and method provides defrost relatively quickly.

According to a first aspect of the present invention, there is provided a defrost system for a subcritical cascade refrigeration system having at least one high stage compressor for compressing a first refrigerant from a low pressure first refrigerant vapor into a high pressure compressed first refrigerant vapor, a high stage condenser operatively connected to the high stage compressor for condensing the compressed first refrigerant vapor at least partially into a condensed first refrigerant, a high stage heat exchanger operatively connected to the high stage condenser for receiving the condensed first refrigerant, at least one low stage compressor, operatively connected to the high stage heat exchanger, for compressing a second refrigerant comprising R-744 refrigerant from a low pressure second refrigerant vapor into a high pressure compressed second refrigerant vapor, the compressed second refrigerant vapor being condensed into condensed second refrigerant liquid having a refrigerant temperature between 20 and 25 degrees Fahrenheit (20° F. and 25° F.) in the high stage heat exchanger by absorption of heat therefrom by the condensed first refrigerant which is evaporated into the low pressure first refrigerant vapor for circulation to the high stage compressor, connected to the high stage heat exchanger, for subsequent compressing, the second refrigerant liquid being transmitted to a reservoir connected to the high heat exchanger for storage and from the reservoir, during a refrigeration cycle to at least one low stage evaporator of a plurality of evaporators for absorbing load heat from a thermal load to cool the thermal load and being at least partially evaporated by the load heat into the low pressure second refrigerant vapor for subsequent compressing by the low stage compressor, the defrost system comprising:

a defrost inlet heat exchanger operatively connected to the high stage condenser, the high stage heat exchanger, and the reservoir; and at least one defrost compressor operatively connected to each evaporator and to the defrost inlet heat exchanger for circulation therethrough of the condensed first refrigerant from the high stage condenser to the high stage heat exchanger and a defrost portion of the second refrigerant liquid between the reservoir and the defrost compressor during the defrost cycle, the defrost portion being evaporated in the defrost inlet heat exchanger by absorption of an additional defrost heat load from the condensed first refrigerant and circulated to the defrost compressor for compression thereby during the defrost cycle into a high pressure defrost vapor portion, the defrost vapor portion being circulated from the defrost compressor into a selected evaporator of the evaporators in a reverse flow compared to the refrigeration cycle, frost on the selected evaporator being melted by absorption of a defrost heat from the defrost portion, thereby defrosting the selected evaporator, with the defrost vapor portion at least partially condensing into a condensed defrost portion at a temperature range from about 35 degrees Fahrenheit to about 38 degrees Fahrenheit, the condensed defrost portion being circulated from the selected evaporator to the high stage heat exchanger for condensation therein into the second refrigerant liquid and circulation to the reservoir, the additional defrost heat load ensuring that the defrost heat for the defrost portion is sufficient to melt the frost.

According to a second aspect of the present invention, there is provided a subcritical cascade refrigeration system comprising:

at least one high stage compressor for compressing a first refrigerant from a low pressure first refrigerant vapor into a high pressure compressed first refrigerant vapor;

a high stage condenser operatively connected to the high stage compressor for condensing the compressed first refrigerant vapor at least partially into a condensed first refrigerant;

a high stage heat exchanger operatively connected to the high stage condenser for receiving the condensed first refrigerant;

at least one low stage compressor, operatively connected to the high stage heat exchanger, for compressing a second refrigerant comprising R-744 refrigerant from a low pressure second refrigerant vapor into a high pressure compressed second refrigerant vapor, the compressed second refrigerant vapor being condensed into condensed second refrigerant liquid having a refrigerant temperature between 20 and 25 degrees Fahrenheit in the high stage heat exchanger by absorption of heat therefrom by the condensed first refrigerant which is evaporated into the low pressure first refrigerant vapor for circulation to the high stage compressor, operatively connected to the high stage heat exchanger, for subsequent compressing into the compressed first refrigerant vapor;

a reservoir operatively connected to the high stage heat exchanger for receiving the second refrigerant liquid therefrom for storage;

a plurality of evaporators connected operatively connected to the reservoir and to the low stage compressor, at least one the evaporator receiving, during a refrigeration cycle, the second refrigerant liquid absorbing load heat from a thermal load to cool the thermal load and being at least partially evaporated by the load heat into the low pressure second refrigerant vapor for subsequent compressing by the low stage compressor;

a defrost inlet heat exchanger operatively connected to the high stage condenser, the high stage heat exchanger, and the reservoir; and at least one defrost compressor operatively connected to each evaporator and to the defrost inlet heat exchanger for circulation therethrough of the condensed first refrigerant from the high stage condenser to the high stage heat exchanger and a defrost portion of the second refrigerant liquid between the reservoir and the defrost compressor during the defrost cycle, the defrost portion being evaporated in the defrost inlet heat exchanger by absorption of an additional defrost heat load from the condensed first refrigerant and circulated to the defrost compressor for compression thereby during the defrost cycle into a high pressure defrost vapor portion, the defrost vapor portion being circulated from the defrost compressor into a selected evaporator of the evaporators in a reverse flow compared to the refrigeration cycle, frost on the selected evaporator being melted by absorption of a defrost heat from the defrost portion, thereby defrosting the selected evaporator, with the defrost vapor portion at least partially condensing into a condensed defrost portion at a temperature range from about 35 degrees Fahrenheit to about 38 degrees Fahrenheit, the condensed defrost portion being circulated from the selected evaporator to the high stage heat exchanger for condensation therein into the second refrigerant liquid and circulation to the reservoir, the additional defrost heat load ensuring that the defrost heat for the defrost portion is sufficient to melt the frost.

According to a third aspect of the present invention, there is provided a method for defrosting a selected evaporator of a plurality of evaporators in a subcritical cascade refrigeration system having at least one high stage compressor for compressing a first refrigerant from a low pressure first refrigerant vapor into a high pressure compressed first refrigerant vapor, a high stage condenser operatively connected to the high stage compressor for condensing the compressed first refrigerant vapor at least partially into a condensed first refrigerant, a high stage heat exchanger operatively connected to the high stage condenser for receiving the condensed first refrigerant, at least one low stage compressor, operatively connected to the high stage heat exchanger, for compressing a second refrigerant comprising R-744 refrigerant from a low pressure second refrigerant vapor into a high pressure compressed second refrigerant vapor, the compressed second refrigerant vapor being condensed into condensed second refrigerant liquid having a refrigerant temperature between 20 and 25 degrees Fahrenheit in the high stage heat exchanger by absorption of heat therefrom by the condensed first refrigerant which is evaporated into the low pressure first refrigerant vapor for circulation to the high stage compressor, connected to the high stage heat exchanger, for subsequent compressing, the second refrigerant liquid being transmitted to a reservoir connected to the high heat exchanger for storage and from the reservoir, during a refrigeration cycle to at one of the evaporators for absorbing load heat from a thermal load to cool the thermal load and being at least partially evaporated by the load heat into the low pressure second refrigerant vapor for subsequent compressing by the low stage compressor, the method comprising the steps of:

providing an additional defrost heat load to a defrost portion of second refrigerant liquid by evaporating the defrost portion in a defrost inlet heat exchanger by absorption of the additional defrost heat load from the condensed first refrigerant in a defrost inlet heat exchanger operatively connected to the reservoir and the high stage condenser;

after providing the additional defrost heat load, compressing the defrost portion into a compressed high pressure defrost vapor portion in a defrost compressor operatively connected to the defrost inlet heat exchanger;

circulating the defrost vapor portion from the defrost compressor through the selected evaporator in a reverse flow compared to the refrigeration cycle, frost on the selected evaporator being melted by absorption of a defrost heat from the defrost vapor portion, the selected evaporator being thereby defrosted, the defrost vapor portion being at least partially condensed into a defrost condensed portion at a temperature range from about 35 degrees Fahrenheit to about 38 degrees Fahrenheit, the additional heat load ensuring that the defrost heat is sufficient to melt the frost; and circulating the defrost condensed portion to the high stage heat exchanger for condensing therein into the second refrigerant liquid having a refrigerant temperature between 20 and 25 degrees Fahrenheit.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following FIGURE, wherein:

FIG. 1 is a schematic view of a cascade R-744 refrigeration system deploying an embodiment of a reverse cycle gas defrost system and method in accordance with the present invention.

DETAILED DESCRIPTION OF THE PREFERRED EMBODIMENTS

With reference to the annexed drawings the preferred embodiments of the present invention will be herein described for indicative purpose and by no means as of limitation.

Referring to FIG. 1, there is schematically shown a subcritical cascade R-744 refrigeration system, shown generally as 10, having a reverse cycle gas defrost system or subsystem, shown generally as 12, a high stage refrigeration system or subsystem, shown generally as 100, and a low stage refrigeration subsystem or system, shown generally as 102. For the refrigeration system 10, a first, high stage, refrigerant is compressed, condensed, and then evaporated in the high stage 100 to condense a second, low stage R-744 refrigerant which is used to cool a thermal load in the low stage system 102. The first refrigerant may be any suitable refrigerant conventionally used in the high stage of cascade refrigeration systems, for example ammonia, Freon®, or the like. The second refrigerant is R-744, i.e. carbon dioxide based refrigerant.

The refrigeration system 10 includes, for the high stage system 100, at least one high stage compressor 16, at least one high stage heat exchanger 22, and at least one high stage condenser 20, all operatively connected to one another by high stage refrigerant conduits 42 as well as, between condenser 20 and high stage heat exchanger 22, to defrost inlet heat exchanger 24. For the low stage system 102, the refrigeration system 10 includes at least one low stage compressor 26, a plurality of evaporators 14, and an R-744 refrigerant reservoir 28, all operatively connected to one another and to the high stage heat exchanger 22 by conduits by refrigerant conduits 44, 46, 48, 50, 52, 54, 56, 60, 64, 68, 70, 72, 78. The defrost system 12 includes at least one dedicated defrost compressor 30, evaporators 14, defrost outlet heat exchanger 32, and defrost inlet heat exchanger 24 operatively connected to, and between, reservoir 28 and defrost compressor 30 by conduits 60, 64. Conduits 42, 44, 46, 48, 50, 52, 54, 56, 60, 64, 68, 70, 72, 78 may be of any type known in the art suitable for circulation of the respective high stage and low stage refrigerants.

The refrigeration system 10 has essentially two cycles, namely a refrigeration cycle and a defrost cycle. During the refrigeration cycle, a thermal load, such as foodstuffs or the like, is cooled by one or more evaporators 14 to a desired temperature. During the defrost cycle, one or more selected evaporators 14 is defrosted. It should be noted that, if desired, the defrost cycle may occur simultaneously with the refrigeration cycle, provided only a subset of the evaporators 14 is defrosted during the defrost cycle. The activation of the defrost cycle may occur on a fixed schedule or may be triggered by detection of a predefined quantity of frost on an evaporator 14 by one or more sensors, not shown, disposed in proximity to the evaporators 14.

For the refrigeration cycle of the refrigeration system 10, the first refrigerant, generally as low pressure first refrigerant vapor, is drawn from the output of the high stage heat exchanger 22 into the high stage compressor 16 operatively connected thereto, for example via first high stage conduit 42*a*. The high stage compressor 16 compressor compresses the low pressure first refrigerant vapor into high pressure compressed first refrigerant vapor which circulates from the output of compressor 16 to the high stage condenser 20, for example through second high stage conduit 42*b* which operatively connects high stage compressor 16 and condenser 20. In the high stage condenser 20, the compressed high pressure first refrigerant vapor is condensed, and at least partially liquefied, into condensed first refrigerant. From the high stage condenser 20, the warm condensed first refrigerant is circulated to throttling valve 40 and heat exchanger 22 through third and fourth high stage conduits 42*c*, 42*d* and defrost inlet heat exchanger 24, operatively connected by conduits 42*c*, 42*d* to and between condenser 20 and throttling valve 40. The throttling valve or device 40, which may be an expansion valve 40 for expanding the condensed first refrigerant, is in turn operatively connected to high stage heat exchanger 22, i.e. high stage evaporator, by conduit 42*d* and regulates flow of the first condensed refrigerant into the high stage heat exchanger 22 from the defrost inlet heat exchanger 24.

As the first refrigerant is compressed, condensed and circulated from compressor 16 and condenser 20 to throttling device 40 and heat exchanger 22 in high stage system 100, the R-744 second refrigerant is compressed and circulated to high stage heat exchanger 22 in low stage system 102. Specifically, during the refrigeration cycle, the second refrigerant, primarily as low pressure second refrigerant vapor at low pressure, is received through low stage compressor inlet conduit 44 by compressor 26 from evaporator outlet conduits 46 of evaporators 14. Each evaporator 14 has at least one respective evaporator outlet conduit 46 connected thereto and to the low stage compressor inlet conduit 44 to operatively connect each evaporator 14 to the compressor 26 for circulation of the low pressure second refrigerant vapor to the compressor 26. The low stage compressor 26 compresses the low pressure second refrigerant vapor into a high pressure compressed second refrigerant vapor. The compressed second refrigerant vapor circulates from compressor 26 to the high stage heat exchanger 22 through low stage compressor outlet conduit 48 operatively connecting compressor 16 to high stage heat exchanger 22. In the high stage heat exchanger 22, the compressed second refrigerant vapor is condensed into condensed second refrigerant liquid having a temperature between 20 and 25 degrees Fahrenheit (20° F. and 25° F.) by absorption of heat from the high pressure compressed second refrigerant vapor by the condensed first refrigerant, which is at least partially evaporated thereby. Thus, the high stage heat exchanger 22 serves as the low stage condenser 22 for the second, R-744 based, refrigerant of low stage system 102 during the refrigeration cycle.

From the high stage heat exchanger 22, the condensed second refrigerant liquid is circulated to reservoir 28 for storage through reservoir inlet conduit 50, which operatively connects high stage exchanger 22 and reservoir 28. From reservoir 28, the condensed second refrigerant liquid circulates through first reservoir outlet conduit 52, then through evaporator inlet conduits 54 into low stage expansion valves 58 disposed thereon, and then into evaporators 14 engaged in the refrigeration cycle, each evaporator 14 being connected to reservoir outlet conduit 52 by respective conduit 54 therefor. In the evaporators 14 engaged in the refrigeration cycle, the second refrigerant liquid, expanded by the expansion valves 58, absorbs heat from the thermal load, thus providing refrigeration, and is at least partially evaporated into low pressure second refrigerant vapor, which is then fed through evaporator outlet conduit 48 connected to the low stage compressor inlet conduit 44 back to low stage compressor 28 for the next refrigeration cycle.

When the defrost cycle is initiated, a defrost portion of the condensed second refrigerant liquid is drawn from the reservoir 28 through defrost inlet heat exchanger 24 to defrost compressor 30. The defrost inlet heat exchanger 24 is operatively connected to, and between, reservoir 28 and defrost compressor 30, for example by conduits 60, 64. More specifically, defrost portion is drawn from reservoir 28 through second reservoir outlet conduit 60 into defrost inlet expansion valve 62 disposed thereon and then into the defrost inlet heat exchanger 24, the conduit 60 operatively connecting heat exchanger 24 to reservoir 28 for circulation of second condensed refrigerant. In the defrost inlet heat exchanger 24, the defrost portion is at least partially evaporated, by absorption of an additional defrost heat load from the warmer condensed first refrigerant circulated therethrough, into a low pressure defrost portion of low pressure second refrigerant. The additional heat load provided to the defrost portion ensures that there will be sufficient heat load for the defrost compressor 30, for which the suction temperature is 16° F., and that the defrost heat of the defrost portion contained in the defrost portion will be sufficient to defrost the selected evaporator 14. The defrost inlet expansion valve 62 expands the second refrigerant liquid and lowers the pressure thereof, thus facilitating evaporation and absorption of the additional defrost heat load in the defrost inlet heat exchanger 24. From heat exchanger 24, the low pressure defrost portion of second refrigerant vapor is then circulated through defrost compressor inlet conduit 64 and defrost inlet pressure regulating valve 66 disposed on conduit 64 into defrost compressor 30. The defrost inlet pressure regulating valve 66 ensures that the pressure in conduit 64 for the inlet for the defrost compressor 30 remains constant and does not rise to dangerous levels which could cause breakage of the conduit 64.

In the defrost compressor 30, the defrost portion is compressed into a high pressure defrost vapor portion of second refrigerant vapor having a condensing temperature of approximately 38° F. From the defrost compressor 30, the defrost vapor portion is circulated to the selected evaporator 14, operatively connected thereto, for defrosting the selected evaporator 14. For example, and as shown, the defrost compressor 30 may be connected to defrost compressor outlet conduit 68, or manifold, which is connected, for each evaporator 14, to a respective outlet connector conduit 70 connected to the respective evaporator outlet conduit 46 of the evaporator 14 for circulating the defrost vapor portion from compressor 30 to selected evaporator 14. As the defrost vapor portion circulates through the selected evaporator 14, the defrost heat, including additional defrost heat load, is absorbed by frost on the evaporator 14 as required to melt the frost and defrost the evaporator 14. As the defrost heat is absorbed, the defrost vapor portion is condensed in the selected evaporator 14 into at least partially liquefied condensed defrost portion of second refrigerant. Thus, the selected evaporator 14 is defrosted by reversing the flow of the R 744 refrigerant vapor, compared to the refrigeration cycle, and without recourse to expensive electric defrost techniques or lengthy and space consuming air defrost techniques.

From the selected evaporator 14, the condensed defrost portion circulates to defrost outlet heat exchanger. 32, operatively connected to, and between, evaporators 14 and high stage heat exchanger 22, for example by conduits 54, 56, 72, 78, 48. Specifically, and as shown, the condensed defrost portion circulates from evaporator 14 through evaporator inlet conduit 54, inlet connector conduit 56 connected thereto, and then through heat exchanger inlet conduit 72 connected to inlet connector conduit 56 to heat exchanger 32. As the condensed defrost portion enters the defrost outlet heat exchanger 32, a liquefying portion of the condensed first refrigerant is also circulated from the high stage condenser 20 through high stage conduit 42*e* and defrost outlet expansion valve 76 disposed thereon to defrost outlet heat exchanger 32. The liquefying portion is expanded in expansion valve 76 to reduce the pressure thereof. In the defrost outlet heat exchanger 22, the expanded liquefying portion is at least partially evaporated by absorption of heat from the condensed defrost portion, causing further condensation thereof to ensure that the condensed defrost portion is completely liquefied. The liquefying portion is then circulated through high stage conduit 42*f*, possibly via conduit 42*a*, back to high stage compressor for subsequent compression. The liquefied condensed defrost portion is circulated from defrost outlet heat exchanger through exchanger outlet conduit 78 to the low stage compressor outlet conduit 48 and then through high stage heat exchanger 22. In the high stage heat exchanger 22, the condensed defrost portion is condensed and cooled, as previously described for the refrigeration cycle, to a temperature between 20° F. and 25° F. and circulated as second refrigerant liquid to reservoir 28 for subsequent use for refrigeration or defrost.

In order to ensure that the frost is adequately defrosted in the selected evaporator 14, defrost pressure regulating valve 80 regulates pressure in defrost outlet heat exchanger 32, selected evaporator 14 and respective connecting conduits 56, 54, 70, 68 connected thereto, as well as conduits 72, 78 to ensure that the respective pressure therein of second refrigerant is above pressure in conduit 48 and high enough to keep the condensing temperature of the defrost vapor portion and defrost condensing portion at a minimum of 35° F., and thereby above the freezing point of 32° F. for frost on the selected evaporator. Maintenance of the condensing temperature of the defrost portion of at least 35° F. ensures that the defrost vapor portion will condense above the freezing point of the frost and will melt the frost of selected evaporator 14.

It will be appreciated by one skilled in the art that condenser 20, heat exchangers 22, 24, 32 may be of any conventional type suited for the application of the present invention. Further, the exact arrangement of conduits 42, 44, 46, 48, 50, 52, 54, 56, 60, 64, 68, 70, 72, 78 need not be exactly as shown herein. One skilled in the art will appreciate that any arrangement of conduits that permits the elements 14, 16, 20, 22, 24, 26, 28, 30, 32, 40, 62, 66, 76, 80 to be operatively connected as herein described may be deployed.

While a specific embodiment of the invention has been described, those skilled in the art will recognize many alterations that could be made within the spirit of the invention, which is defined solely according to the following claims.

We claim:

1. A defrost system for a cascade refrigeration system having at least one high stage compressor for compressing a first refrigerant from a low pressure first refrigerant vapor into a high pressure compressed first refrigerant vapor, a high stage condenser operatively connected to the high stage compressor for condensing the compressed first refrigerant vapor at least partially into a condensed first refrigerant, a high stage heat exchanger operatively connected to the high stage condenser for receiving the condensed first refrigerant, at least one low stage compressor, operatively connected to the high stage heat exchanger, for compressing a second refrigerant comprising R-744 refrigerant from a low pressure second refrigerant vapor into a high pressure compressed second refrigerant vapor, the compressed second refrigerant vapor being condensed into condensed second refrigerant liquid having a refrigerant temperature between 20 and 25 degrees Fahrenheit in the high stage heat exchanger by absorption of heat therefrom by the condensed first refrigerant which is evaporated into the low pressure first refrigerant vapor for circulation to the high stage compressor, connected to the high stage heat exchanger, for subsequent compressing, the second refrigerant liquid being transmitted to a reservoir connected to the high heat exchanger for storage and from the reservoir, during a refrigeration cycle to at least one low stage evaporator of a plurality of evaporators for absorbing load heat from a thermal load to cool the thermal load and being at least partially evaporated by the load heat into the low pressure second refrigerant vapor for subsequent compressing by the low stage compressor, the defrost system comprising:

a defrost inlet heat exchanger operatively connected to the high stage condenser, the high stage heat exchanger, and the reservoir; and at least one defrost compressor operatively connected to each evaporator and to said defrost inlet heat exchanger for circulation therethrough of the condensed first refrigerant from the high stage condenser to the high stage heat exchanger and a defrost portion of the second refrigerant liquid between the reservoir and the defrost compressor during the defrost cycle, the defrost portion being evaporated in said defrost inlet heat exchanger by absorption of an additional defrost heat load from the condensed first refrigerant and circulated to said defrost compressor for compression thereby during the defrost cycle into a high pressure defrost vapor portion, said defrost vapor portion being circulated from said defrost compressor into a selected evaporator of the evaporators in a reverse flow compared to the refrigeration cycle, frost on said selected evaporator being melted by absorption of a defrost heat from said defrost portion thereby defrosting said selected evaporator, with said defrost vapor portion at least partially condensing into a condensed defrost portion at a temperature range from about 35 degrees Fahrenheit to about 38 degrees Fahrenheit, said condensed defrost portion being circulated from said selected evaporator to the high stage heat exchanger for condensation therein into the second refrigerant liquid and circulation to the reservoir, said additional defrost heat load ensuring that said defrost heat for said defrost portion is sufficient to melt said frost.

2. The defrost system of claim 1, further comprising a defrost outlet heat exchanger operatively connected to the high stage condenser and the high stage compressor and to the evaporators and the high stage heat exchanger, said defrost heat outlet exchanger receiving, during said defrost cycle, said condensed defrost portion circulated therethrough from said selected evaporator to the high stage heat exchanger and a liquefying portion circulated therethrough of the condensed first refrigerant from the high stage condenser to the high stage compressor, said liquefying portion absorbing heat from said condensed defrost portion in said defrost outlet heat exchanger and thereby completely liquefying said condensed defrost portion subsequently circulated to the high stage heat exchanger and at least partially evaporating said liquefying portion into the low pressure first refrigerant vapor for circulation to the high stage compressor.

3. The defrost system of claim 2, further comprising a defrost outlet expansion valve operatively connected to the high stage condenser and said defrost outlet heat exchanger, said defrost outlet expansion valve receiving said liquefying portion from the high stage condenser and expanding said liquefying portion to reduce respective pressure thereof prior to circulation from said defrost outlet expansion valve of said liquefying portion to said the defrost outlet heat exchanger.

4. The defrost system of claim 2, further comprising a defrost pressure regulating valve disposed on a heat exchanger outlet conduit connecting said defrost compressor outlet conduit to a low stage compressor outlet conduit connecting the low stage compressor to the high stage heat exchanger, the condensed defrost portion flowing through said heat exchanger outlet conduit from said defrost outlet heat exchanger to said low stage compressor outlet conduit through said defrost pressure regulating valve during the defrost cycle, the defrost pressure regulating valve maintaining a pressure of the defrost portion in the heat exchanger outlet conduit, the selected evaporator, and in said defrost outlet heat exchanger above an outlet pressure in the low stage compressor outlet conduit.

5. The defrost system of claim 4, wherein the defrost pressure regulating valve further regulates said pressure to a level sufficiently high to ensure that said defrost vapor portion and condensed defrost portion will condense at the condensing temperature range of between about 35 degrees Fahrenheit and about 38 degrees Fahrenheit.

6. The defrost system of claim 1, further comprising a defrost inlet expansion valve operatively connected to the reservoir and said defrost inlet heat exchanger disposed on a reservoir outlet conduit connecting the reservoir to said defrost inlet heat exchanger, said defrost inlet expansion valve expanding said defrost portion circulated therethrough from the reservoir to facilitate absorption of the additional defrost heat load from the first refrigerant liquid in said defrost inlet heat exchanger.

7. The defrost system of claim 1, further comprising a defrost inlet pressure regulating valve disposed on a defrost compressor inlet conduit operatively connecting said defrost inlet heat exchanger and said defrost compressor, said defrost inlet pressure regulating valve regulating pressure of the defrost portion entering the defrost compressor to a constant pressure level.

8. A subcritical cascade refrigeration system comprising:

at least one high stage compressor for compressing a first refrigerant from a low pressure first refrigerant vapor into a high pressure compressed first refrigerant vapor;

a high stage condenser operatively connected to said high stage compressor for condensing said compressed first refrigerant vapor at least partially into a condensed first refrigerant;

a high stage heat exchanger operatively connected to said high stage condenser for receiving said condensed first refrigerant;

at least one low stage compressor, operatively connected to said high stage heat exchanger, for compressing a second refrigerant comprising R-744 refrigerant from a low pressure second refrigerant vapor into a high pressure compressed second refrigerant vapor, said compressed second refrigerant vapor being condensed into condensed second refrigerant liquid having a refrigerant temperature between 20 and 25 degrees Fahrenheit in said high stage heat exchanger by absorption of heat therefrom by said condensed first refrigerant which is evaporated into said low pressure first refrigerant vapor for circulation to said high stage compressor, operatively connected to said high stage heat exchanger, for subsequent compressing into said compressed first refrigerant vapor;

a reservoir operatively connected to said high stage heat exchanger for receiving said second refrigerant liquid therefrom for storage;

a plurality of evaporators connected operatively connected to said reservoir and to said low stage compressor, at least one said evaporator receiving, during a refrigeration cycle, said second refrigerant liquid absorbing load heat from a thermal load to cool said thermal load and being at least partially evaporated by said load heat into said low pressure second refrigerant vapor for subsequent compressing by said low stage compressor;

a defrost inlet heat exchanger operatively connected to said high stage condenser, said high stage heat exchanger, and said reservoir; and at least one defrost compressor operatively connected to each evaporator and to said defrost inlet heat exchanger for circulation therethrough of said condensed first refrigerant from said high stage condenser to said high stage heat exchanger and a defrost portion of said second refrigerant liquid between said reservoir and said defrost compressor during said defrost cycle, said defrost portion being evaporated in said defrost inlet heat exchanger by absorption of an additional defrost heat load from said condensed first refrigerant and circulated to said defrost compressor for compression thereby during said defrost cycle into a high pressure defrost vapor portion, said defrost vapor portion being circulated from said defrost compressor into a selected evaporator of said evaporators in a reverse flow compared to the refrigeration cycle, frost on said selected evaporator being melted by absorption of a defrost heat from said defrost portion thereby defrosting said selected evaporator, with said defrost vapor portion at least partially condensing into a condensed defrost portion at a temperature range from about 35 degrees Fahrenheit to about 38 degrees Fahrenheit, said condensed defrost portion being circulated from said selected evaporator to said high stage heat exchanger for condensation therein into said second refrigerant liquid and circulation to said reservoir, said additional defrost heat load ensuring that said defrost heat for said defrost portion is sufficient to melt said frost.

9. The refrigeration system of claim 8, further comprising a defrost outlet heat exchanger operatively connected to said high stage condenser and said high stage compressor and to said evaporators and said high stage heat exchanger, said defrost heat outlet exchanger receiving, during said defrost cycle, said condensed defrost portion circulated therethrough from said selected evaporator to said high stage heat exchanger and a liquefying portion circulated therethrough of said condensed first refrigerant from said high stage condenser to said high stage compressor, said liquefying portion absorbing heat from said condensed defrost portion in said defrost outlet heat exchanger and thereby completely liquefying said condensed defrost portion, subsequently circulated to said high stage heat exchanger, and at least partially evaporating said liquefying portion into said low pressure first refrigerant vapor for circulation to said high stage compressor.

10. The refrigeration system of claim 9, further comprising a defrost outlet expansion valve operatively connected to said high stage condenser and said defrost outlet heat exchanger, said defrost outlet expansion valve receiving said liquefying portion from said high stage condenser and expanding said liquefying portion to reduce said pressure thereof prior to circulation from said defrost outlet expansion valve of said liquefying portion to said defrost outlet heat exchanger.

11. The refrigeration system of claim 9, further comprising a defrost pressure regulating valve disposed on a heat exchanger outlet conduit connecting said defrost outlet heat exchanger to a low stage compressor outlet conduit connecting said low stage compressor to said high stage heat exchanger, said condensed defrost portion flowing through said heat exchanger outlet conduit from said defrost outlet heat exchanger to said heat exchanger inlet conduit through said defrost pressure regulating valve during said defrost cycle, said defrost pressure regulating valve maintaining a pressure of said defrost portion in said heat exchanger outlet conduit, said defrost outlet heat exchanger, and said selected evaporator above an outlet pressure in said low stage compressor outlet conduit.

12. The refrigeration system claim 11, wherein said defrost outlet pressure regulating valve further regulates said pressure to a level sufficiently high to ensure that said defrost vapor portion and condensed defrost portion will condense at the condensing temperature range of between about 35 degrees Fahrenheit and about 38 degrees Fahrenheit.

13. The refrigeration system of claim 8, further comprising a defrost inlet expansion valve operatively connected to said reservoir and said defrost inlet heat exchanger on a reservoir outlet conduit connecting said reservoir to said defrost inlet heat exchanger, said defrost inlet expansion valve expanding said defrost portion circulated therethrough from said reservoir to facilitate absorption of said additional defrost heat load from said first refrigerant liquid in said defrost inlet heat exchanger.

14. The refrigeration system of claim 8, further comprising a defrost inlet pressure regulating valve disposed on a defrost compressor inlet conduit operatively connecting said defrost inlet heat exchanger and said defrost compressor, said defrost inlet pressure regulating valve regulating pressure of said defrost portion entering said defrost compressor to a constant pressure level.

15. A method for defrosting a selected evaporator of a plurality of evaporators in a cascade refrigeration system having at least one high stage compressor for compressing a first refrigerant from a low pressure first refrigerant vapor into a high pressure compressed first refrigerant vapor, a high stage condenser operatively connected to the high stage compressor for condensing the compressed first refrigerant vapor at least partially into a condensed first refrigerant, a high stage heat exchanger operatively connected to the high stage condenser for receiving the condensed first refrigerant, at least one low stage compressor, operatively connected to the high stage heat exchanger, for compressing a second refrigerant comprising R-744 refrigerant from a low pressure second refrigerant vapor into a high pressure compressed second refrigerant vapor, the compressed second refrigerant vapor being condensed into condensed second refrigerant liquid having a refrigerant temperature between 20 and 25 degrees Fahrenheit in the high stage heat exchanger by absorption of heat therefrom by the condensed first refrigerant which is evaporated into the low pressure first refrigerant vapor for circulation to the high stage compressor, connected to the high stage heat exchanger, for subsequent compressing, the second refrigerant liquid being transmitted to a reservoir connected to the high heat exchanger for storage and from the reservoir, during a refrigeration cycle to at one of the evaporators for absorbing load heat from a thermal load to cool the thermal load and being at least partially evaporated by the load heat into the low pressure second refrigerant vapor for subsequent compressing by the low stage compressor, the method comprising the steps of:

providing an additional defrost heat load to a defrost portion of second refrigerant liquid by evaporating said defrost portion in a defrost inlet heat exchanger by absorption of said additional defrost heat load from said condensed first refrigerant in a defrost inlet heat exchanger operatively connected to said reservoir and said high stage condenser;

after providing said additional defrost heat load, compressing said defrost portion into a compressed high pressure defrost vapor portion in a defrost compressor operatively connected to said defrost inlet heat exchanger;

circulating said defrost vapor portion from said defrost compressor through said selected evaporator in a reverse flow compared to the refrigeration cycle, frost on said selected evaporator being melted by absorption of a defrost heat from said defrost vapor portion, said selected evaporator being thereby defrosted, said defrost vapor portion being at least partially condensed into a defrost condensed portion at a temperature range from about 35 degrees Fahrenheit to about 38 degrees Fahrenheit, said additional heat load ensuring that said defrost heat is sufficient to melt said frost; and circulating said defrost condensed portion to said high stage heat exchanger for condensing therein into said second refrigerant liquid having a refrigerant temperature between 20 and 25 degrees Fahrenheit.

16. The method of claim 15, further comprising the step of:

regulating the pressure of said defrost vapor portion in said selected evaporator with a defrost pressure regulating valve to ensure that said defrost vapor portion condenses therein at the condensing temperature range of between about 35 degrees Fahrenheit and about 38 degrees Fahrenheit.

17. The method of claim 15, further comprising the step of:

prior to circulating said defrost condensed portion to said high stage heat exchanger, liquefying the defrost condensed portion by absorption of heat therefrom by a liquefying portion of said condensed first refrigerant in a defrost outlet heat exchanger operatively connected to said high stage condenser, said high stage compressor, said selected evaporator and said high stage heat exchanger.

* * * * *